United States Patent [19]

Seegmiller

[11] Patent Number: 4,775,266

[45] Date of Patent: Oct. 4, 1988

[54] STRUCTURE AND METHOD FOR DETERRING CUTTER ROOF FAILURE

[76] Inventor: Ben L. Seegmiller, 3500 E. Loren Von Dr., Salt Lake City, Utah 84124

[21] Appl. No.: 946,018

[22] Filed: Dec. 22, 1986

[51] Int. Cl.[4] ..... E21D 20/00

[52] U.S. Cl. ..... 405/288; 405/259

[58] Field of Search ..... 405/259, 260, 261, 262, 405/288

[56] References Cited

U.S. PATENT DOCUMENTS

| | | | |
|---|---|---|---|
| 4,456,405 | 6/1984 | Galis | 405/288 |
| 4,498,816 | 2/1985 | Korpela et al. | 405/259 |
| 4,596,496 | 6/1986 | Tyrell et al. | 405/288 |
| 4,601,616 | 7/1986 | Barish et al. | 405/288 |
| 4,630,974 | 12/1986 | Sherman | 405/288 |
| 4,679,967 | 7/1987 | Hipkins et al. | 405/288 |

FOREIGN PATENT DOCUMENTS

| | | | |
|---|---|---|---|
| 1222640 | 6/1960 | France | 405/259 |
| 1297817 | 5/1962 | France | 405/259 |

OTHER PUBLICATIONS

Cutter Roof Failure: An Overview of the Causes and Methods for Control, Bureau of Mines Information, circular IC 9094 (1986) by John L. Hill III, published by the United States Department of the Interior.

*Primary Examiner*—David H. Corbin

*Attorney, Agent, or Firm*—M. Ralph Shaffer

[57] ABSTRACT

Structure and method for deterring cutter roof failure in underground mines such as coal mines. An elemental device of such structure comprises a unique bracket accommodating angulated bolting and having end-apertured flanges suitable for accommodating mutually horizontal tie rods disposed in tension. A series of the bracket devices are mutually spaced end-to-end and are longitudinally aligned parallel and generally proximate to a rib-roof juncture. Connecting tie rods intercoupling the bracket devices, are disposed in tension and, because of such, the roof strata proximate the roof-rib edge is placed longitudinally in compression. Truss support structures incorporating a plurality of devices can be made up to support and place in compression in large roof areas to deter roof failure. The method involved, for deterring cutter roof failure, is to provide, in one form of the invention, the said bracket devices and then anchoring the same over, e.g., the pillar areas and joining the bracket devices together lying essentially parallel to rib-roof junctures along an elongate path.

14 Claims, 4 Drawing Sheets

STRUCTURE AND METHOD FOR DETERRING CUTTER ROOF FAILURE

FIELD OF INVENTION

The present invention relates to the prevention and/or deterring of cutter roof failure in underground mines such as coal mines, and, more particularly, presents a method, device, and structure suitable for preventing and/or deterring such failure by means of angulated anchoring of bracket devices proximate the cutter stress area then connecting together such devices in horizontal tension so as to place in compression the roof strata thereover and, e.g., proximate the corners of the mine opening relative to the rib line and the roof being supported. The invention includes truss structures incorporating such devices for supporting mine roofs, especially at the corner areas where cutter failure is likely to occur.

BACKGROUND AND BRIEF DESCRIPTION OF PRIOR ART

In the past a number of devices and methods have been used addressing the problem of mine roof control. Perhaps the best summary of the current state of the art is in the Bureau of Mines Information Circular (1986), designated IC 9094 and entitled Cutter Roof Failure: an Overview of the Causes and Methods for Control, the same having a principal author of John L. Hill III and published by the United States Department of the Interior. The disclosure therein is fully incorporated by way of reference. Also pertinent are the inventor's prior patent applications entitled Mine Truss Structure and Method, Ser. No. 06/809,140 filed Dec. 16, 1985 and allowed Patent Application entitled Truss Systems and Components Thereof, Ser. No. 06/809,139, filed Dec. 16, 1985, both of these patent applications also being incorporated herein by way of reference. No hardware or method are believed known, nor does the inventor believe himself aware of any patent or other literature, wherein angle-bolting hardware as provided herein includes means lateral tension securement of mutually-spaced, end-to-end facing adjacent devices such that roof strata in a mine be placed in compression by incorporation of angle bolting devices and tensioned tie rods connecting the same, proximate the area where cutter failure is likely to occur. Nor is there known any truss structures incorporating such bracket devices wherein the elongate, rib adjacent or proximate areas of the roof can be pre-stressed in compression to overcome the tension of force fields naturally occurring in the strata proximate the entry corner areas. In said Bureau of Mines Information Circular, anchor-bolting hardware and anchor bolt types are illustrated in FIGS. 25 and 27 of the publication. However, in cases of conditions leading to severe cutter roof failure, the installations alone of angle bolts and their brackets are not sufficient to overcome the dangerous condition present and to prospective cutter failure. The cribbing and posts are generally used currently in the art for the support of the roof after cutter failure has formed; cribs and posts, of course, should be installed shortly after mining, and the support should be positioned in the mine in such a way as not to yield significantly.

Another problem that inheres in present practice is the fact that cutter failure frequently propogates at areas just above the anchor horizon of the longest anchor bolt; and this can result in massive roof failure.

Even the installations of successive rebar-type bolts with the point-anchoring feature, and even though such are uniformly tensioned, do not deter the severe problem chanced through the appearance of cutter fractures.

For convenience, and by way of definition, the following may be taken as an approximate definition of cutter roof failure:

Cutter Roof Failure, according to the Bureau of Mines Publication, in mine roof rock "is a failure process that initially begins as a fracture point in the roof rock parallel to, and located at, the roof-rib intersection."

Such fractures occur through a wide variety of angles, generally will be from a vertical position proximately in line with the rib line to approximately 30 degrees relative to the horizontal and oriented over the roof. A customary fracture approximate 60 degrees relative to the horizontal defined by the roof, extending over the opening. Once initiated along the roof-rib line or its extrapolation, a cutter fracture may propagate away from the rib-roof line and actually cross the roof's span, continuing the other side of the room. Various modes of failure are illustrated in the Bureau of Mines Publication.

BRIEF DESCRIPTION OF INVENTION

According to the present invention a basic component is a distinctive mine bracket, the same comprising, e.g., a mine roof engaging support plate and, welded thereto on the underside thereof, a pair of opposed end flanges suitably apertured and connecting to a connection flange. The latter supports and is welded to a gusseted angular plate that is apertured for receiving an angulated roof bolt. An accommodating elongated aperture appears in the support plate to provide access for the angulated mine roof bolt passing therethrough. The gusseted angular plate has an upper nut reaction surface receiving the nut threaded onto the roof bolt and being tightened against such reaction surface.

The end flanges are apertured so as to provide for the connection of tie rods having threaded ends, respective ones of which pass through the apertures of such end flanges, and with securement nuts being fastened to such tie rod ends and engaging the inner surfaces of the end flanges.

For multiple tie rod structures, the connector flange of the bracket may itself be elongated and include one or more apertures for receiving cross-oriented tensioning tie rods.

Complete structure may take any one of several forms as the full description of preferred embodiments of the invention hereinafter points out. In certain ones of such trussing structures, a series of rectilinearly aligned, mutually-spaced brackets are provided with respective angulated roof bolts and are interconnected together by tie rods that are maintained in tension by their end nuts. The combination of the tie rods and the brackets create an elongate rectilinear trussing structure disposed closely adjacent and/or nominally parallel to or extrapolated from the line apex formed by the mine roof and pillar rib. In this way cutter roof failure is avoided, or at least substantially deterred. The reason for this is not only by virtue of the inclusion of the tensioned angulated roof bolts that are anchored to the roof strata, i.e., above the pillars, e.g., beyond the rib lines, but also by virtue of the fact that the tensioned tie rods securing the brackets together being placed in substantial tension maintain the roof strata thereabove in compression. This so as to overcome the naturally occurring tension zone in the roof which might lead to roof bulge or other roof instability and perhaps fallout. Additionally, the bracket plurality with their several roof bolts and the inclusion of the tensioned tie rods therebetween serve to add rigidity to the support of the roof structure so that, should one roof area proximate a particular mine roof bolt be unstable, the other brackets will still tend to support the brackets over the stable area to preclude fallout or malfunction proximate the weakened mine roof area surrounding the first-mentioned bracket.

Trussing structure across an entry, along opposite sides of the roof adjacent the opposite rib lines, and even at open passageway intersection areas, can provide a very sturdy trussing function. Opposite side structures may be interconnected by suitable tie rod means with the possibility of inclusion of medial support plates engaging the mine roof at several locations.

The method inherent in the invention comprises the steps of providing a series of bracket supports for a mine roof proximate the elongate, essentially horizontal rib-roof line, i.e., at the apex intersection thereof, or its extrapolated extension at, e.g., passageway intersection areas, and providing means for interconnecting the brackets in tensioned truss spans so as to create compression zones in the roof strata and thereby overcome tendencies of the roof to fail. Structured securement of roof bolts associated with the brackets are, again, maintained by the anchor ends of the roof bolts being, in one form of the invention, above the mine pillars beyond the rib lines of the mine opening.

OBJECTS

Accordingly, a principal object of the present invention is to provide a new and improved mine roof support bracket.

A further object is to provide a mine bracket so configured as to permit a mutually-spaced series of such brackets to be coupled together rectilinearally end-to-end, in mutually spaced configurement by suitable tie rods and their end attachments.

A further object is to provide a method for shoring up mine roofs proximate upper portions of the roof areas of a mine.

An additional object is to provide roof trussing structure for mines, such structure taking any one of several forms, the forms selected depending upon the mine characteristics encountered.

A further object is to provide a mine bracket suitably apertured to receive not only the mine bolt but also a series of tie rods for truss construction purposes.

BRIEF DESCRIPTION OF DRAWINGS

The present invention may best be understood by reference to the following description, taken in connection with the accompanying drawings in which.

DESCRIPTION OF PREFERRED EMBODIMENTS

Figure 1:
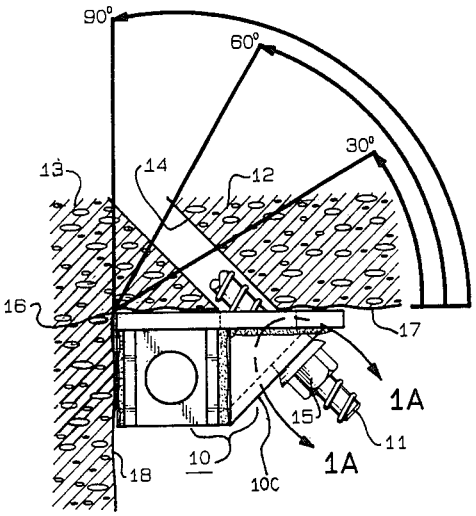
FIG. 1 is a side elevation, partially in section, of a mine opening showing the rib and roof lines and the intersection or juncture therebetween; a bracket of the present invention is shown installed proximate the rib line, albeit for prospective cutter problems the bracket is preferably mounted from one to five feet from the ribline, or its extened extrapolation, of the mine opening.

In FIG. 1 mine roof bracket 10 is shown secured in place by angulated roof bolt 11 which is secured into the mine roof strata 12 over pillar 13. Aperture 14 accommcdates positionment of the roof bolt 11. The mine roof bracket is secured in place by nut 15. While for some conditions it is conceivable that the bracket will be installed proximate the apex 16 or juncture, or its extrapolation into open entry-intersection areas, as between the mine roof surface 17 and the ribline 18, in practice, where cutter fracture persists or is likely, the bracket is preferably installed from one to five feet from the ribline, this so that aperture 14 will not proceed near the apex and proximate that area most likely to cutter-failure. In practice and as to coal mines, cutter fissures are likely to occur along fracture planes from 30 to 90 degrees relative to the horizontal roof surface; in practice, the 60 degree line shown in FIG. 1 is an average angulation plane along which or proximate which cutter fissures are generally most likely to occur.

Figure 1A:
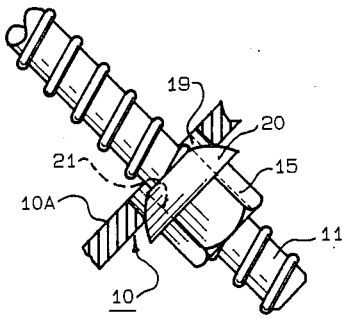
FIG. 1A is an enlarged detail taken along the arcuate line 1A—1A in FIG. 1, illustrating the type of nut that is employed to secure an elongated angular roof bolt to the mine roof within the mine roof bracket of the present invention.
Figure 2:
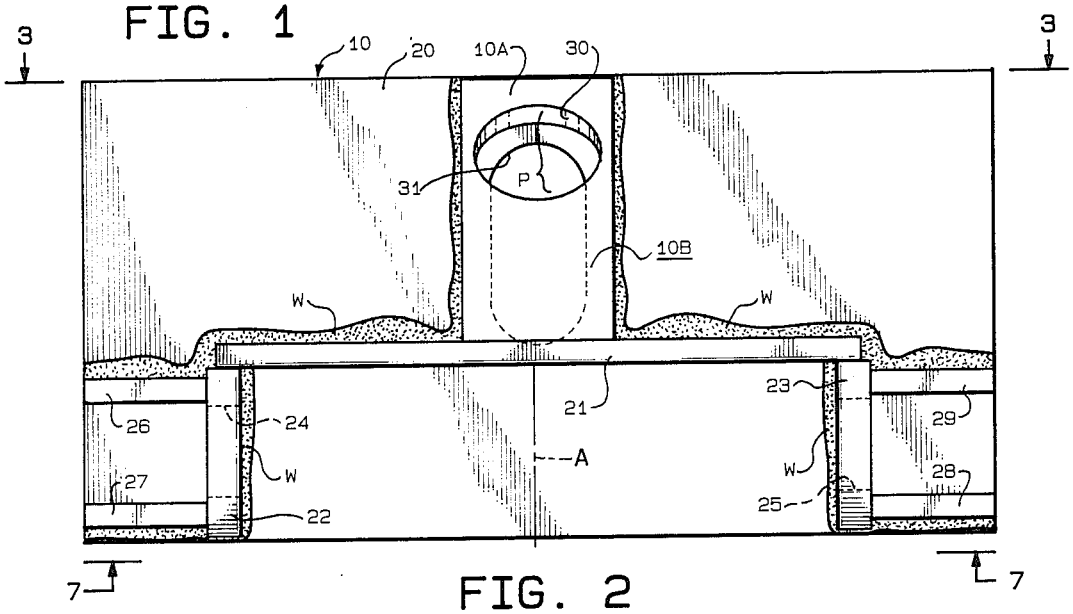
FIG. 2 is a bottom plan of a roof support bracket in a preferred embodiment of the present invention.
Figure 3:
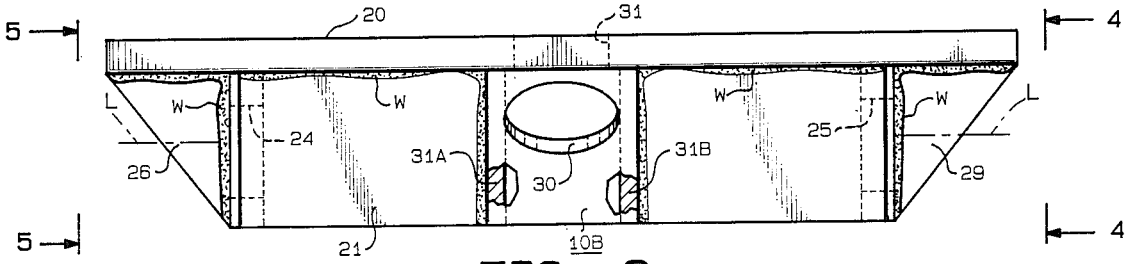
FIG. 3 is a side elevation of the structure of FIG. 2.
Figure 4:
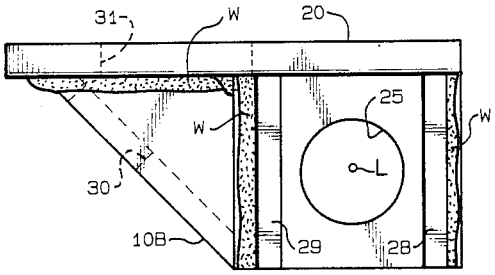
FIG. 4 is an end elevation of the mine roof bracket and is taken along the line 4—4 in FIG. 3.
Figure 5:
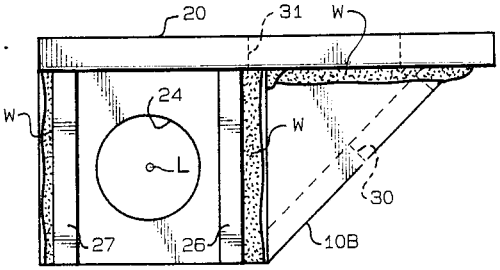
FIG. 5 is also an end elevation of the mine roof bracket of FIG. 3 and is taken along the line 5—5 in FIG. 3.
Figure 6:
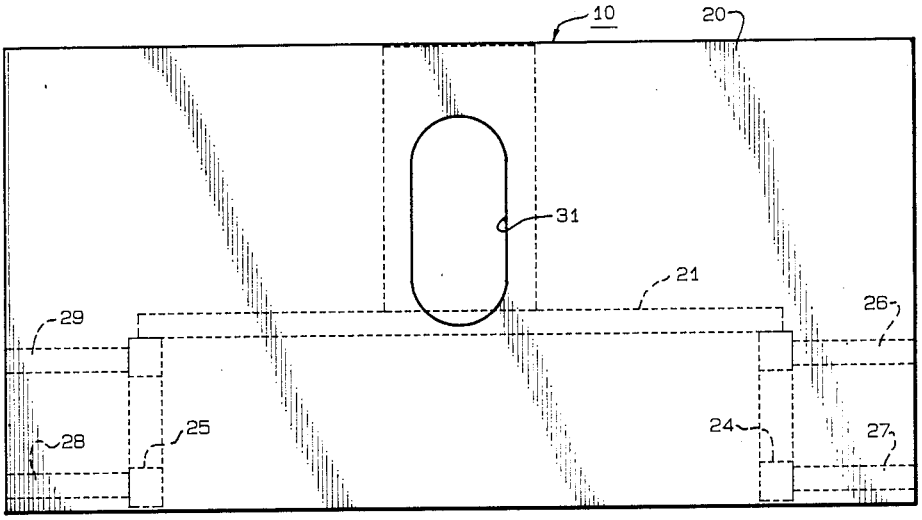
FIG. 6 is a top plan of the brackets of FIGS. 1-5 with portions thereof as well as apertures being shown in dotted line configurement.
Figure 7:
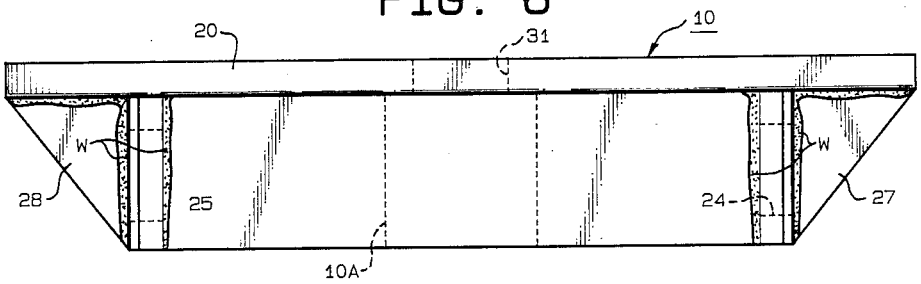
FIG. 7 is a rear side elevation of the mine roof bracket of the invention.

FIG. 1A illustrates that an angulated plate 10A forming a part of the mine roof bracket 10 includes aperture 19 for receiving the roof bolt 11. Nut 15 includes an enlarged, mushroom-like hemispherical top 20 that is suitably apertured at 21 to receive the bolt. This type of nut is ideally suited to make the attachment structure essentially self-aligning and so as to center the roof bolt relative to aperture 19.

Figure 8:
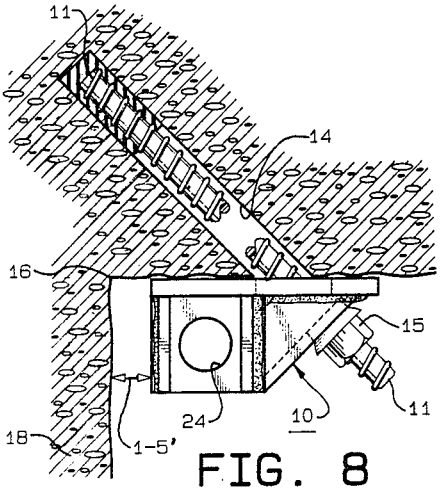
FIG. 8 illustrates the installation of a respective mine roof bracket, constructed in accordance with FIGS. 1-7, and with the mine roof bracket being spaced from one to five feet of the ribline of the mine opening such that the angular hole accommodating the roof bolt will not proceed through present or prospective cutter areas proximate the apex or juncture between the ribline and the exposed roof surface defining the mine opening.

A preferred embodiment of the mine roof bracket 10 is illustrated in FIGS. 2–7. In these figures the bracket 10 includes a rectangular roof support plate 20 having longitudinal axis and, integrally depending from such plate, a depending connection flange 21 and end flanges 22 and 23, these latter flanges being apertured at tie rod apertures 24 and 25 which are coaxially disposed along a horizontal line L. Gussets 26–29 welded in place to provide for supporting the end flanges 22 and 23. Likewise, angular plate 10A includes, see FIG. 3, triangular gussets 31A and 31B. The connection flange 21, end flanges 22 and 23, the angulated plate 10A of angular structure 10B and the gussets 30 and 31 associated therewith are all welded together by welds W. Apertures 30 and 31 in the angular plate and also in the roof support plate 20 are are disposed in vertical plane A, transverse to aperture line L, and are provided for the installation of roof bolt 11. In installation the angulated or sloping roof bolt 11 will pass through passageway P formed by apertures 30 and 31 for securement in a manner as illustrated in FIG. 8. FIG. 8 also illustrates that in practice, for cutter control, the mine roof bracket will be spaced from the ribline at rib 18 a distance of from one to five feet, this for insuring that the roof bolt aperture 14 through the mine roof strata will not be disposed essentially through the most critical area (1-5') so far as cutter fissures are concerned, i.e., at the apex or juncture 16 between the roof surface 17 and the ribline 18, and also so that sufficient support will be maintained proximate the rib-roof junction and that the angulated roof bolts need not be unduly long for anchoring over the pillar. It is to be noted that the plate associated with angular structure 10B has an outer surface serving as a bearing surface at 10C for nut 15.

Figure 9:
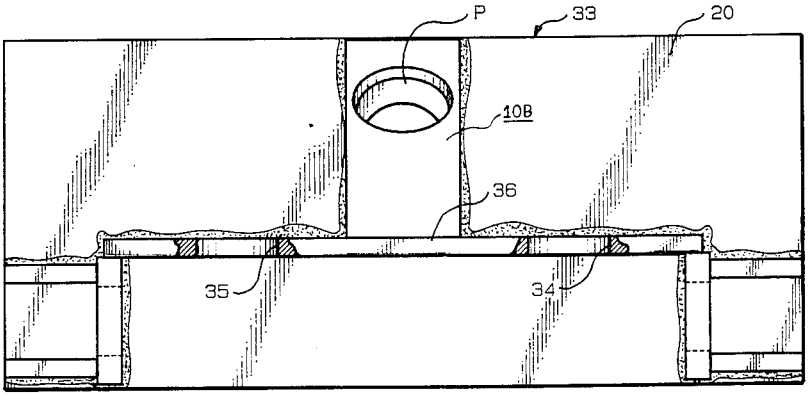
FIG. 9 is a bottom plan of an alternate mine roof bracket wherein the depending connection flange has a pair of apertures accommodating transversely disposed tensionable tie rods with nut attachments.

The mine roof bracket 33 in FIG. 9 is essentially the same as that seen in FIG. 1 with the exception that, this time, a pair of apertures at 34 and 35 are shown disposed at depending connection flange 36, the latter corresponding to the connection flange 21 in FIG. 1. These apertures may be one, two, or more in number and may be disposed in offset fashion relative to passageway P, or one of the same may be actually proximately aligned such aperture where the connection flange is right enough to accommodate an aperture proximate the angular structure (10B) area.

Figure 10:
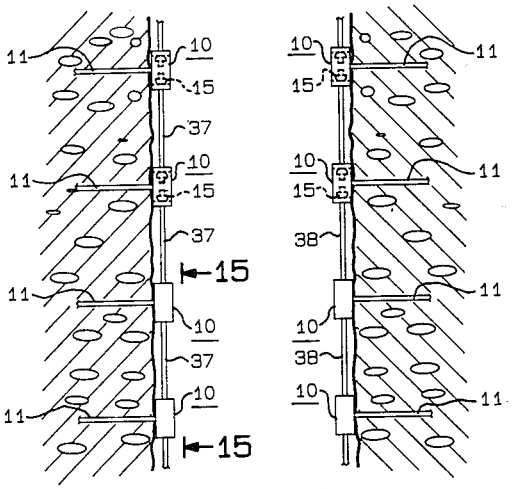
FIGS. 10-13 illustrate in top plan various trussing structures that can be employed to truss various types of mine openings; all of these figures are in top plan proximate the roof plane.
Figure 15:
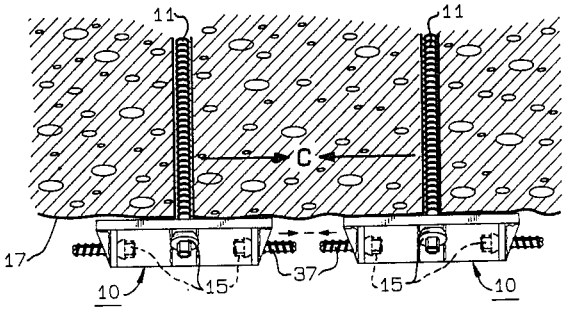
FIG. 15 is a side elevation taken along the line 15—15 in FIG. 10.

FIGS. 10 and 15 illustrate that one or a pair of sets of mine roof brackets 10 may be disposed such that the separate sets are each rectilinear and nominally parallel to the ribline of the mine opening or even at a roof area beyond the ribs, as for example, at an intersection opening, three-way or four-way, by way of example. These brackets will be installed by the roof bolts 11 as seen in FIG. 1 in the manner shown in FIGS. 1, 1A, and 8. It is to be noted that the nuts effect a tensioning of the roof bolt and the tightening down of the bracket to press against the roof, whereas additional tie rods at 37 and 38, by way of example, are used to couple the brackets end-to-end, such additional tie rods also being provided with nuts 15. These nuts 15 are for the purpose of tensioning the tie rod such that the roof area above the brackets and these additional tie rods are also placed in compression, overcoming the naturally occurring tensional forces and stress fields thereat. This is clearly seen in FIG. 15.

Figure 11:
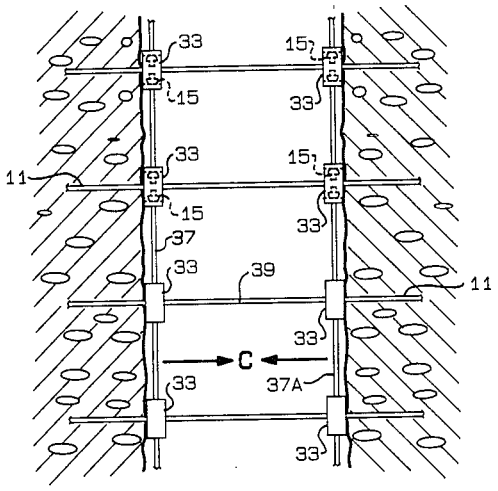

FIG. 11 is similar to FIG. 10, illustrating that brackets 33 may be secured together by additional tie rods 38 proximate one or more holes 34, 35, wherever they may be oriented in the connecting flange 36 of bracket 33 in FIG. 9. Accordingly, these additional tie rods will likewise be supplied nuts 15 to accomplish the tensioning of the tie rods and hence the placing in compression of the entire roof span, at least essentially so. Referring again to FIG. 10, it is to be noted that either one side or, alternately, both sides, see FIG. 11, of the entry can be supplied with the brackets 10, for example, which brackets will be intercoupled by suitable tie rod means as at 37A, 39. All of the tie rods will, of course, be supplied with their cooperating tensioning nuts 15.

Figure 12:
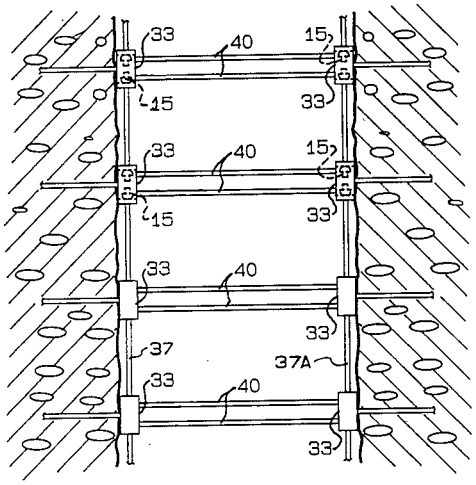
Figure 13:
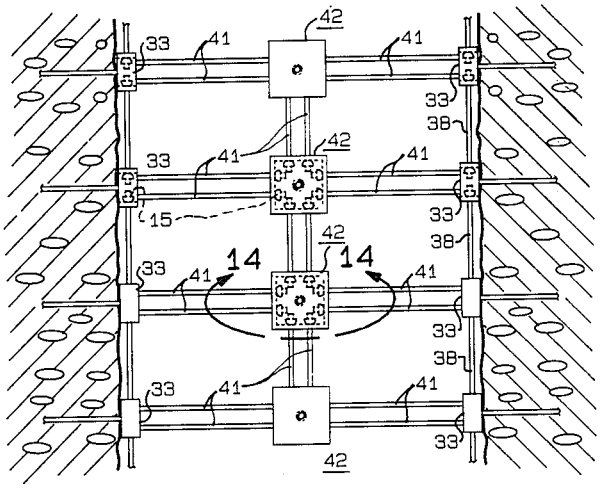
Figure 14:
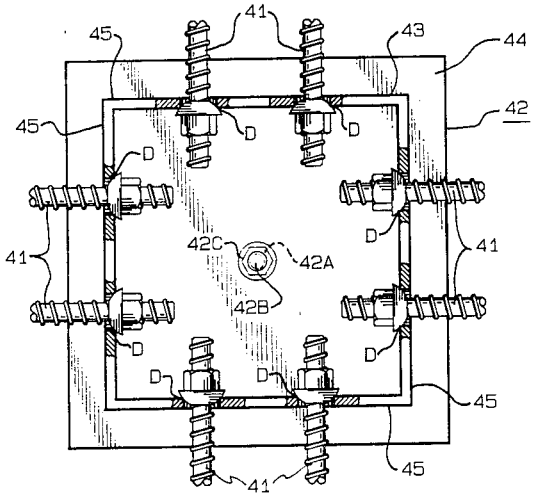
FIG. 14 is a bottom plan of a central support bracket and is taken along the arcuate line 14—14.

FIG. 12 indicates trussing structure wherein cross-trussing tie rods 40 intercouple in tension opposite mine roof brackets 33, for example, see FIG. 9. These likewise will be supplied the conventional tightening nuts 15 which tension the rods to thereby place in compression the roof strata above such tie rods 40. A somewhat similar trussing structure is illustrated in FIG. 13, wherein intermediate bearing plate support structures 42, see also FIG. 14, themselves may be centrally or medially located for supporting medial portions of the roof strata. These may preferably be supplied with respective central apertures 42A accommodating the positionment of anchor bolts 42B, similar in configuration and mounting to bolts 11, and having bolt-tensioning nuts 42C. A series of tie tensionable rods 41, themselves having tightening nuts 15, interconnect the several mine roof brackets 33 to the intermediate bearing plate support structures 42, as FIG. 14 illustrates; such intermediate support structure comprises a bearing plate 44, provided said aperture 42A, and a series of integral, depending flanges 45 which have apertures at D accommodating the several tie rods 41. Flanges 45 will simply be welded to the bearing plate 44 at 43.

It is seen that by tightening the several tie rods 37, 38, as well as all of the tie rods 41, substantial portions of the roof structure may be trussed and hence maintained in a compression (C) state, overcoming the fracture-prone tension zones that might otherwise exist. Importantly, the tensioning of the several tie rods 37 in rectilinear 37, dispose essentially rectilinearally with their several brackets 33, will distribute stress fields and place in essential compression the roof strata proximate the rib lines, and extensions thereof in the intersection areas, this so that the cutter failure is essentially precluded.

FIG. 15 illustrates importantly an essential concept of the invention wherein aligned brackets 10 as, for example, parallel to the ribline or its extrapolation, will essentially deter if not preclude cutter failure.

Relative to FIGS. 11–13, it will be noted that, if desired, the cross-spanning tie rods, rather than being parallel and normal to the ribline, can be simply crossed or even laterally angulated, connecting desired brackets whether these are in actual transverse correspondence or not.

Figure 16:
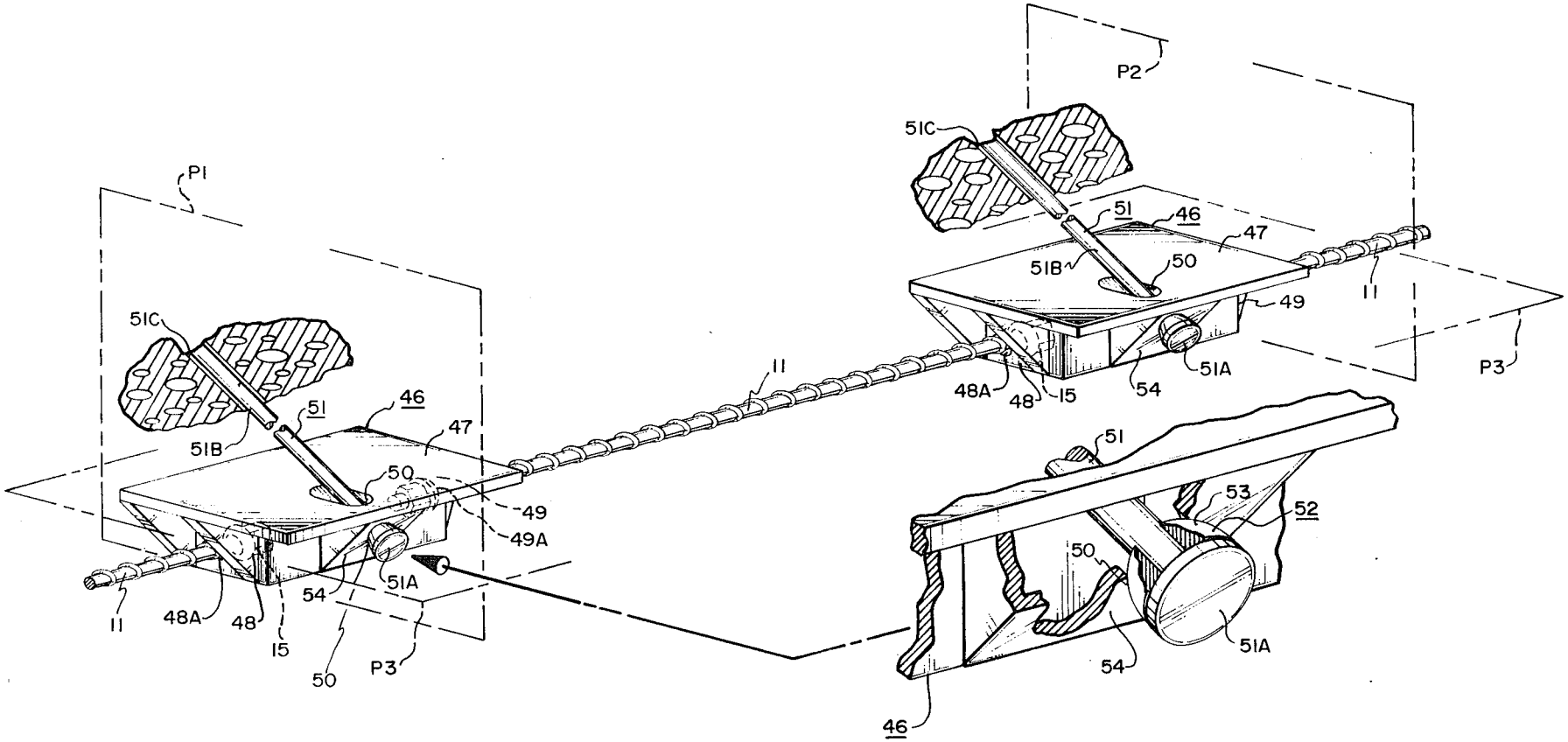
FIG. 16 is an alternate, bracket-truss structure.

In FIG. 16 mine brackets 46 may be cast or fabricated and, in any event, have strata-support bearing surfaces 47 and opposite ends 48 and 49. Canted aperturess 50 are provided for receiving mounting bolts 51. The latter may be threaded or unthreaded, however anchored, and, if unthreaded, will generally be headed, having headed ends formed by forging or any other convenient manner. These headed ends are designated at 51A. Apertures 50 will be oversize relative to shanks 51B of bolts 51. Importantly, washers 52 are provided and have inner convex surfaces of revolution, preferably hemispherical, at 53. It will be noted that these latter surfaces protrude into apertures 50, at least slightly, so these will serve a self-aligning function relative to the mine bolt shank and the oversized aperture 50. The mine bolt, in this latter instance, can simply be turned in a conventional epoxy zone within the strata aperture at 51C, with the headed end of the bolt engaging the washer and the latter seating into bracket aperture 50. Brackets 46 are alternate forms of brackets 10 in FIG. 1; the anchor bolts 11 of FIG. 1 may be replaced by unthreaded anchor bolts 51 in FIG. 16 where tensioned mounting of the brackets relative to the mine strata is not required. The end-to-end tensioned coupling by tie rods 11, nuts 15, and the provision of bracket ends 48, 49, with tie rod admittance apertures 48A and 49A, of the mutually-spaced brackets is transverse to the anchor bolts 51. It is noted in FIG. 16 that the mutually horizontally spaced vertical planes P1, P2, in which are respectively disposed the anchor bolts 51, normally and transversely intersect horizontal plane P3 which is defined by horizontal tie rods 11.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A mine roof bracket including, in combination: a roof support plate, angular structure integral with said support plate and having an angular bearing surface, said support plate and said angular structure having essentially aligned apertures, disposed in a vertical plane and comprising an angulated, external roof bolt passageway, with said bearing surface accommodating a tensioning, external roof bolt engagement nut, said support plate being provided with mutually-spaced, depending, apertured end flanges essentially mutually aligned in a direction transverse to said bolt passageway and provided with a similarly mutually and coaxially aligned tie-rod receiving apertures disposed along a horizontal line transversely intersecting said vertical plane.

2. A mine roof bracket including, in combination: a horizontal roof support plate having a longitudinal axis, a depending connection flange depending from and parallel to the longitudinal axis of said roof support plate, a pair of end flanges transversely connected to opposite ends of said connection flange and also integral with and depending from said roof support plate, said end flanges having respective, mutually coaxially aligned, tie rod receiving apertures, disposed along a horizontal line, a sloping plate joined to said connection flange, at a side opposite to the positionment of said end flanges, and also to said support plate, said sloping plate and said support plate having respective aligned apertures, which mutually coaxially aligned in a vertical plane transverse to said horizontal line of said rod receiving apertures, designed to accommodate the passage therethrough of an external sloping roof bolt.

3. The bracket of claim 2 wherein said connection flange is provided with an aperture positioned to receive an external, laterally disposed cross-trussing tie rod.

4. The bracket of claim 2 wherein said connection flange is provided with a pair of apertures mutually-spaced on opposite sides of said sloping plate, said connection plate apertures being constructed to receive respective, external cross-trussing tie rods.

5. A mine roof bracket including, in combination: a roof support plate, a pair of mutually-spaced flanges, having coaxially aligned apertures disposed along a horizontal line, and depending from said plate, said flanges being constructed to comprise mounting means for the ends of respective external tie rods, sloping structure integral with a depending from said plate, said sloping structure being offset with respect to but generally between said flanges, the combination of said sloping structure and said plate being provided with a sloping roof bolt passageway disposed in a vertical plane transversely intersecting said horizontal line, said sloping structure having a sloping reaction surface being constructed to accommodate external tensioning means abutment when such tensioning means is applied to an external roof bolt when the latter passes through said passageway.

6. A cutter control trussing structure for longitudinal, essentially parallel, proximate mounting disposition relative to the longitudinal juncture of the rib and roof of a mine opening, said trussing structure including, in combination: A series of mutually rectilinearly spaced, end-to-end facing mine roof brackets each comprising a roof support plate, a pair of mutually-spaced flanges provided with coaxially aligned apertures and depending from said plate and constructed to comprise mounting means for the ends of respective tie rods, said apertures being coaxially disposed along a horizontal line, sloping structure integral with and depending from said plate, said sloping structure being offset with respect to but generally between said flanges, the combination of said sloping structure and said plate being provided with a sloping roof bolt passageway disposed in a vertical plan transversely intersecting said horizontal line, said sloping structure having a sloping reaction surface being constructed to accommodate tensioning means' abutment tensioning means is applied to an exterior roof bolt when the latter passes through said passageway; a series of tie rods having respective threaded ends passing through said apertures of mutually facing ones of said flanges of adjacent ones of said brackets; a series of securement nuts comprising said tie rod tensioning means and being threaded onto said tie road ends and reacting against said flanges, respectively; a series of nominally parallel, sloping roof bolts passing through said bracket sloping passageways and constructed for anchoring in mine roof strata, said roof bolts having threaded ends accommodating securement to said brackets; and nuts respectively engaging ones of said roof bolts, and reacting against said sloping surfaces of said depending sloping structure, for tensioning said roof bolts when so installed and for securing said plates of said brackets against the mine roof.

7. A cutter control trussing structure for longitudinal, essentially parallel, proximate mounting disposition relative to the opposite longitudinal junctures, of the opposite ribs and spanning roof of a mine opening, said trussing structure including, in combination: Two corresponding trnasversely-spaced series of mutually rectilinearly end-to-end spaced, mine roof brackets, each of said series being constructed for respective proximate parallel disposition relative to said junctures, and each of said brackets comprising a roof support plate, a pair of mutually-spaced flanges having apertures and depending from said plates and constructed to comprise mounting means for the ends. respective tie rods, sloping structure integral with and depending from said plate, said sloping structure being offset with respect to but generally between said flanges, the combination of said sloping structure and said plate being provided with a sloping roof bolt passageway, said sloping structure having a sloping reaction surface being constructed to accommodate tensioning means abutment when such tensioning means is applied to an exterior roof bolt when the latter passes through said passageway; a series of tie rods having respective threaded ends passing through mutually facing ones of said flanges, at respective ones of said apertures thereof, of adjacent ones of said brackets; a series of securement nuts comprising tie rod tensioning means and being threaded onto said tie rod ends and reacting against said flanges, respectively; a series of nominally parallel, sloping roof bolts passing through said bracket sloping passageways and constructed for anchoring in mine roof strata, said roof bolts having threaded ends accommodating securement to said brackets; and nuts respectively engaging respective ones of said roof bolts, and reacting against said sloping surfaces of said depending sloping structures, for tensioning said roof bolts when so installed and for securing said plates of said brackets against the mine roof; and plural tensioned tie rod means transversely intercoupling selected brackets of said two series.

8. The structure of claim 7 wherein said tensioned tie rod means include intermediate bearing plate support structures, and plural second tie rod means for intercoupling in tension said bearing plate support structures.

9. The structure of claim 8 wherein said bearing plate support structures each include respective roof bolts anchoring means for anchoring in tension said intermediate bearing plate support structure to said mine roof.

10. In an underground mine opening defined by mutually spaced pillars spanned by a roof, mutually oppositely facing sides of said pillars comprising ribs intersecting with said roof to comprise respective rib-roof intersection junctures, a method of trussing said roof against cutter failure, comprising the steps of: providing a rectilinear end-to-end disposed series of mutually spaced roof-bearing support brackets against said roof essentially parallel to a respective one of said junctures; anchoring at selected points said brackets in pressure engagement against said roof, whereby to place roof strata between said brackets and the anchor points in compression; and providing tie rod means for tensioned intercoupling of said brackets, whereby also to overcome tension in said roof strata and place in compression the roof strata at areas above and between said brackets.

11. The method of claim 10 wherein said steps are also duplicated for the remaining rib-roof intersection juncture, and intercoupling in tension said brackets transversely underneath said roof for placing in tension the span of said roof immediately above said opening.

12. The method of claim 10 wherein the intercoupling step includes supplying intercoupling structures to effectuate the same and also to pressure engage said roof at areas medially between the opposite bracket series.

13. In an underground mine opening defined by mutually spaced pillars spanned by a roof, mutually oppositely facing sides of said pillars comprising ribs intersecting with said roof to comprise respective rib-roof, longitudinal, intersection junctures, a method of trussing said roof against cutter failure, comprising the steps of: providing a rectilinear end-to-end disposed series of mutually spaced roof-bearing support brackets against said roof, said series being essentially parallel to and spaced transversely horizontally from one to five feet from a respective one of said longitudinal junctures: anchoring at selected points said brackets in pressure engagement against said roof, whereby to place roof strata between said brackets and the anchor points in compression; and providing tie rod means essentially parallel to said one juncture for tensioned in said roof strata and place in compression the roof strata at areas above and between said brackets.

14. In combination, a pair of mutually spaced and mutually end-to-end facing angle mounting brackets for installation in mines, each of said brackets having an upper strata-engaging bearing surface and a canted aperture disposed in a vertical plane and passing through said surface, said brackets each having opposite ends respectively provided with coaxial apertures arranged along a horizontal line, tensioning tie rod means disposed longitudinally essentially in a horizontal plane, essentially including said horizontal line, between and mutually engaging said brackets at said coaxial apertures, and anchor bolts disposed in said canted apertures, respectively, in respective mutually horizontally spaced vertical planes normally and transversely intersecting said horizontal plane, for securing said brackets against mine strata, said tie rod means thus being transverse to said canted apertures.

* * * * *